US011049484B2

(12) United States Patent
Voss et al.

(10) Patent No.: US 11,049,484 B2
(45) Date of Patent: Jun. 29, 2021

(54) MINIATURE SPEAKER WITH ESSENTIALLY NO ACOUSTICAL LEAKAGE

(71) Applicant: Sonion Nederland B.V., Hoofddorp (NL)

(72) Inventors: Rasmus Voss, Hoofddorp (NL); Koen van Gilst, Hoofddorp (NL); Augustinus Josephus Helena Maria Rijnders, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/725,270

(22) Filed: Dec. 23, 2019

(65) Prior Publication Data

US 2020/0211521 A1 Jul. 2, 2020

(30) Foreign Application Priority Data

Dec. 28, 2018 (EP) ..... 18248156

(51) Int. Cl.

| | |
|---|---|
| ***H04R 9/06*** | (2006.01) |
| ***G10K 9/125*** | (2006.01) |
| ***H04R 1/02*** | (2006.01) |
| ***H04R 1/40*** | (2006.01) |
| ***H04R 25/00*** | (2006.01) |

(52) U.S. Cl.

CPC ..... *G10K 9/125* (2013.01); *H04R 1/025* (2013.01); *H04R 1/403* (2013.01); *H04R 25/402* (2013.01)

(58) Field of Classification Search

CPC combination set(s) only.

See application file for complete search history.

(56) References Cited

U.S. PATENT DOCUMENTS

| | | | |
|---|---|---|---|
| 6,788,796 | B1 | 9/2004 | Miles |
| 6,831,577 | B1 | 12/2004 | Furst |
| 6,853,290 | B2 | 2/2005 | Jorgensen |

(Continued)

FOREIGN PATENT DOCUMENTS

| | | | | |
|---|---|---|---|---|
| DE | 102010009453 | A1 | 9/2011 | |
| DE | 102016212717 | * | 7/2016 | ..... H04R 17/02 |

(Continued)

OTHER PUBLICATIONS

Search Opinion for European Patent Application No. 18248156.4, date unknown (4 pages).

*Primary Examiner* — Amir H Etesam

(74) *Attorney, Agent, or Firm* — Nixon Peabody LLP

(57) ABSTRACT

The present invention relates to a miniature speaker comprising front and a rear volume, and one or more moveable diaphragms each comprising one or more cantilever beams, and associated one or more air gaps, arranged between the front and rear volumes, wherein the one or more cantilever beams are configured to bend or deflect in response to an applied drive signal, and wherein the one or more air gaps between the front and rear volumes remain essentially unaffected during bending or deflection of the one or more cantilever beams thus maintaining the acoustical leakage between the front and rear volumes at a minimum. The present invention further relates to a receiver assembly comprising such a miniature speaker, and to a hearing device, such as a receiver-in-canal hearing device, comprising such a receiver assembly.

13 Claims, 8 Drawing Sheets

(56) References Cited

U.S. PATENT DOCUMENTS

| | | | |
|---|---|---|---|
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doom |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 2011/0182453 | A1 | 7/2011 | van Hal |
| 2011/0189880 | A1 | 8/2011 | Bondo |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |

FOREIGN PATENT DOCUMENTS

| | | | |
|---|---|---|---|
| DE | 102017208911 | * | 5/2017 |
| DE | 102017208911 A1 | | 11/2018 |
| EP | 2254353 A2 | | 11/2010 |

* cited by examiner

MINIATURE SPEAKER WITH ESSENTIALLY NO ACOUSTICAL LEAKAGE

CROSS-REFERENCE TO RELATED APPLICATIONS

This application claims the benefit of European Patent Application Serial No. 18248156.4, filed Dec. 28, 2018, which is incorporated herein by reference in its entirety.

FIELD OF THE INVENTION

The present invention relates to a miniature speaker comprising one or more piezoelectric cantilevers beams for generating sound pressure waves. The one or more cantilevers beams are arranged in a manner to that essentially no acoustical leakage exists between a front volume and a rear volume of the miniature speaker.

BACKGROUND OF THE INVENTION

It is well established that an acoustical leakage between a front volume and a rear volume of a miniature speaker significantly reduces the achievable sound pressure level (SPL) of such a speaker. Thus, in order to achieve a high SPL no acoustical leakage should ideally exist between the front volume and the rear volume of a speaker.

Known miniature speakers all seem to suffer from the disadvantages associated with acoustical leakage between front and rear volumes.

It may therefore be seen as an object of embodiments of the present invention to provide miniature speakers having enlarged SPL without increasing the overall volume of the miniature speaker.

It may be seen as a further object of embodiments of the present invention to increase the SPL of miniature speakers by improving the utilization of the miniature speaker area.

It may be seen as an even further object of embodiments of the present invention to increase the SPL of miniature speakers by reducing the acoustical leakage between a front and a rear volume of the miniature speaker.

DESCRIPTION OF THE INVENTION

The above-mentioned objects are complied with by providing, in a first aspect, a miniature speaker comprising a front and a rear volume, and one or more moveable diaphragms each comprising one or more cantilever beams and associated one or more air gaps arranged between the front and rear volumes, wherein the one or more cantilever beams are configured to bend or deflect in response to an applied drive signal, and wherein the one or more air gaps between the front and rear volumes remain essentially unaffected during bending or deflection of the one or more cantilever beams thus maintaining the acoustical leakage between the front and rear volumes at a minimum.

The present invention thus relates to a miniature speaker comprising one or more moveable diaphragms each comprising one or more cantilever beams. The one or more cantilever beams may form an array of cantilever beams, such as a rectangular array of cantilever beams. The rectangular shape is advantageous in that it is highly applicable in relation to miniature speakers having a rectangular housing since a rectangular shaped moveable diaphragm may provide maximum SPL and minimum acoustical leakage.

Each of the one or more cantilever beams may comprise a piezoelectric material sandwiched between two electrodes configured to receive the applied drive signal. The applied drive signal either stretches or compresses the piezoelectric material causing the one or more cantilever beams to bend or deflect accordingly. Bending or deflection of one or more cantilever beams causes an associated moveable diaphragm to move accordingly and thus generate sound pressure waves.

The one or more cantilever beams may be secured to or form part of a MEMS die. The MEMS die may be arranged on a surface of a carrier substrate having a through-going opening arranged therein. The one or more cantilever beams of the MEMS die may be acoustically connected to said through-going opening. As it will be discussed in further details below the carrier substrate may form part of a separation between the front and rear volumes.

The carrier substrate may comprise a printed circuit board or a flex print, the printed circuit board or the flex print comprising electrically conducting paths configured to lead the drive signal to the one or more cantilever beams via the carrier substrate.

Each of the one or more cantilever beams may be pre-bended along a longitudinal direction. The degree of pre-bending may be selected in accordance with desired acoustical properties of the miniature speaker. Moreover, the degree of pre-bending may be set individually for each of the one or more cantilever beams.

An array of cantilever beams may comprise a plurality of cantilever beams, wherein a number of said cantilever beams may be mutually connected via one or more material layers. One or more air gaps may exist between neighboring cantilever beams, or between one or more cantilever beams and a frame structure of the array of cantilever beams. The one or more air gaps may be dimensioned in a manner so that they act as an acoustical low-pass filter having a predetermined acoustical cut-off frequency. The predetermined acoustical cut-off frequency may be between 1 kHz and 3 kHz, such as around 2 kHz. The width of the air gaps may typically be in the range between 0.5 μm and 5 μm.

In the miniature speaker according to the first aspect the front volume may be acoustically connected to a sound outlet of the miniature speaker. Moreover, one or more venting openings may be provided between the rear volume and an exterior volume of the miniature speaker.

In a second aspect the present invention relates to a receiver assembly for a hearing device, the receiver assembly comprising a miniature speaker according to the first aspect of the preceding claims.

In a third aspect the present invention relates to a hearing device, such as a receiver-in-canal hearing device, comprising a receiver assembly according to the second aspect.

In general the various aspects of the present invention may be combined and coupled in any way possible within the scope of the invention. These and other aspects, features and/or advantages of the present invention will be apparent from and elucidated with reference to the embodiments described hereinafter.

BRIEF DESCRIPTION OF THE DRAWINGS

The present invention will now be explained in further details with reference to the accompanying figures, wherein.

Figure 1:
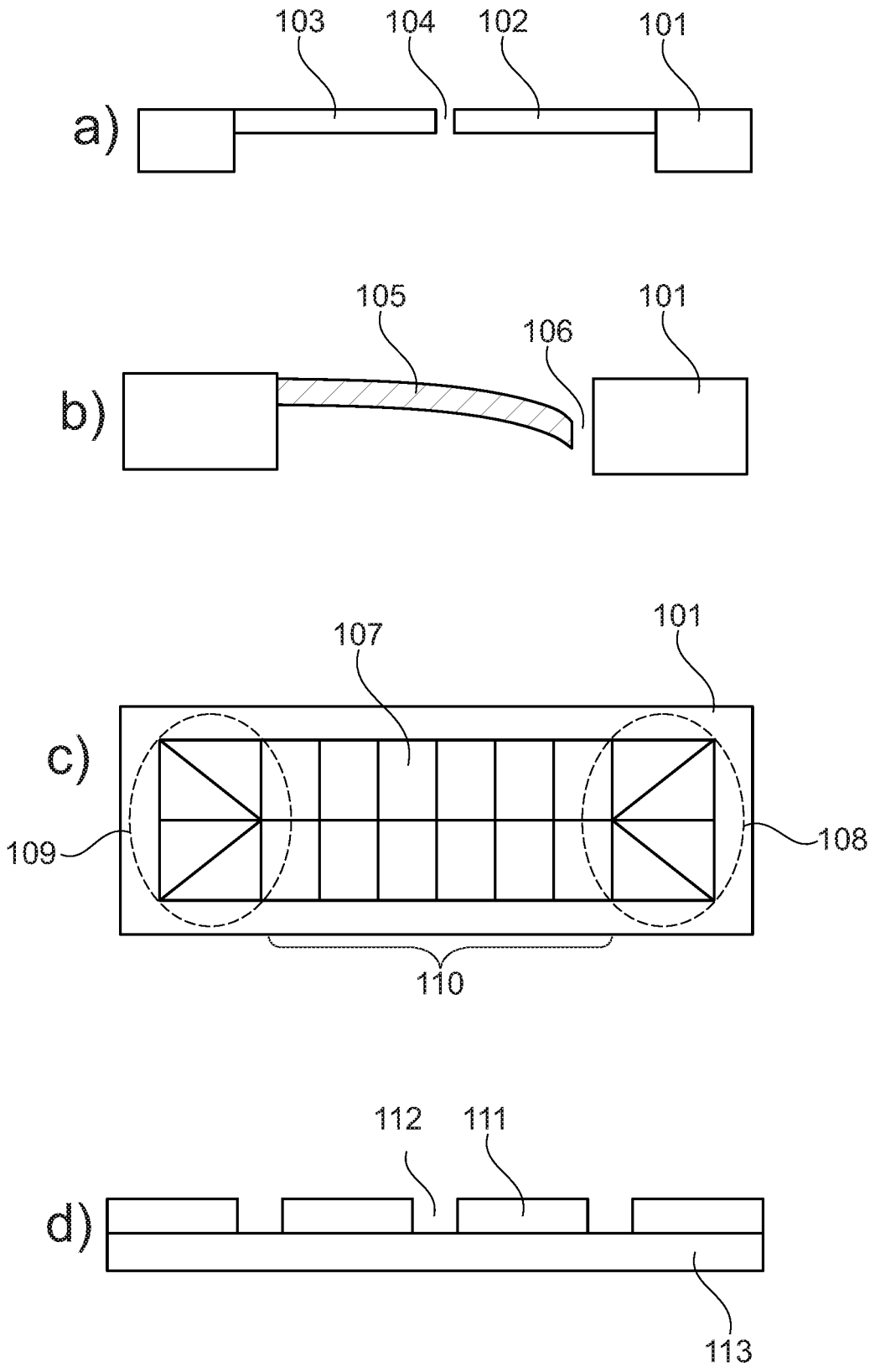
FIG. 1 shows various arrangements of cantilever beams.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In a general aspect the present invention relates to miniature speakers having an increased SPL without increasing the overall volume of the miniature speaker. The increased SPL is provided via an improved utilization of the miniature speaker area, and a minimal acoustical leakage between front and rear volumes. The minimal acoustical leakage is achieved by ensuring that the dimensions of one or more air gaps between the front and rear volumes remain essentially unaffected during bending or deflection of one or more cantilever beams which are capable of generating sound pressure waves in response to applying a drive signal thereto. Thus, during generation of sound pressure waves, i.e. during operation of a miniature speaker according to the present invention, the dimensions of the one or more air gaps may slightly vary. However, these variations do not significantly affect the acoustical properties of the miniature speaker whereby an acoustical leakage in a desired frequency range is avoided. The widths of the air gaps are typically in the range between 0.5 μm and 5 μm.

The one or more cantilever beams may be arranged in various manners, such as a single row of cantilever beams or two opposing rows of cantilever beams. The one or more cantilever beams may thus be arranged in arrays which may be configured and/or optimized to form a moveable diaphragm having a rectangular shape. The rectangular shape is specifically useful and therefore advantageous in relation to miniature speakers having a rectangular housing in that a rectangular shaped diaphragm may provide maximum SPL and minimum acoustical leakage.

Moreover, selected cantilever beams may be connected in order to reduce acoustical leakage through arrays of cantilever beams. The one or more cantilever beams may be straight or they may be pre-bended along a longitudinal direction as explained in further details below.

Each of the one or more cantilever beams comprises an integrated drive mechanism, such as a piezoelectric material sandwiched between two electrodes to which electrodes the drive signal is applied. Upon applying a drive signal to the two electrodes the piezoelectric material will stretch or compress, and the one or more cantilever beams will bend or deflect accordingly. The typical drive signal has an RMS value of around 3 V, but it may, under certain circumstances, be as high as 50 V.

The overall volume of the miniature speaker is below 500 $mm^3$, such as below 400 $mm^3$, such as below 300 $mm^3$, such as below 200 $mm^3$, such as below 100 $mm^3$, such as below 50 $mm^3$, such as around 40 $mm^3$. The typical dimensions of a miniature speaker are 7 mm×3.3 mm×2 mm (L×W×H). The miniature speaker of the present invention is advantageous in that it is capable of delivering a SPL larger than 90 dB, such as larger than 95 dB, although its overall volume is around 40 $mm^3$.

Referring now to FIG. 1*a* a cross-sectional view of two opposing cantilever beams 102, 103 is depicted. The cantilever beams 102, 103 are either secured to or integrated with a MEMS die 101 which thus forms a frame structure relative to the cantilever beams 102, 103. As depicted in FIG. 1*a* a small air gap 104 exists between the cantilever beams 102, 103. In order to prevent, or at least reduce, acoustical leakage through the air gap 104, the air gap 104 is dimensioned so that essentially no sound pressure waves above 2 kHz is capable of flowing through the air gap 104. The air gap 104 thus functions as an acoustical low-pass filter. Now referring to FIG. 1*b* a cross-sectional view of a pre-bended cantilever beam 105 is depicted. Again, the cantilever beam 105 is either secured to or integrated with a MEMS die 101 which thus forms a frame structure. As depicted in FIG. 1*b* a small air gap 106 exists between the cantilever beam 105 and the MEMS die 101. Again, in order to prevent, or at least reduce, acoustical leakage through the air gap 106, the air gap 106 is dimensioned so that essentially no sound pressure waves above 2 kHz are capable of passing through the air gap 106 which thus functions as an acoustical low-pass filter. It should be noted that the dimensions of the air gaps 104, 106 remain essentially unaffected during bending or deflection of the cantilever beams 102, 103, 105 thus maintaining the acoustical leakage through the air gaps 104, 106 at a minimum. The widths of the air gaps 104, 106 are typically in the range between 0.5 μm and 5 μm.

Turning now to FIG. 1*c* a top view of a rectangular array of cantilever beams 107 is depicted. Again, the cantilever beams 107 are either secured to or integrated with the MEMS die 101. In order to prevent, or at least reduce, acoustical leakage through the regions to the right and left 108, 109 of cantilever beams 107 a number of moveable elements are arranged in these regions 108, 109, i.e. between the array 110 of cantilever beams 107 and the MEMS die 101. The moveable elements are adapted to follow the deflections of the cantilever beams 107 in order to prevent that an uncontrolled amount of air escapes through the regions 108, 109 containing the moveable elements. Thus, the array 110 of cantilever beams 107 and the moveable elements in the regions 108, 109 form in combination a moveable diaphragm configured to generate sound pressure waves. In order to prevent that air gaps are formed between the cantilever beams 111, cf. FIG. 1*d*, the cantilever beams 111 may be connected via one or more material layers 113 which are secured to each of the cantilever beams 111. The one or more material layers 113 thus blocks the openings 112 between the cantilever beams 111. The width of the opening 112 is typically in the range between 0.5 μm and 5 μm.

The cantilever beams 102, 103, 105, 107, 109 shown in FIG. 1 may all be activated individually via an integrated drive mechanism, such as a piezoelectric material sandwiched between two electrodes. The integrated drive mechanism is also applicable in relation to the cantilever beams discussed in the following figures.

Figure 2:
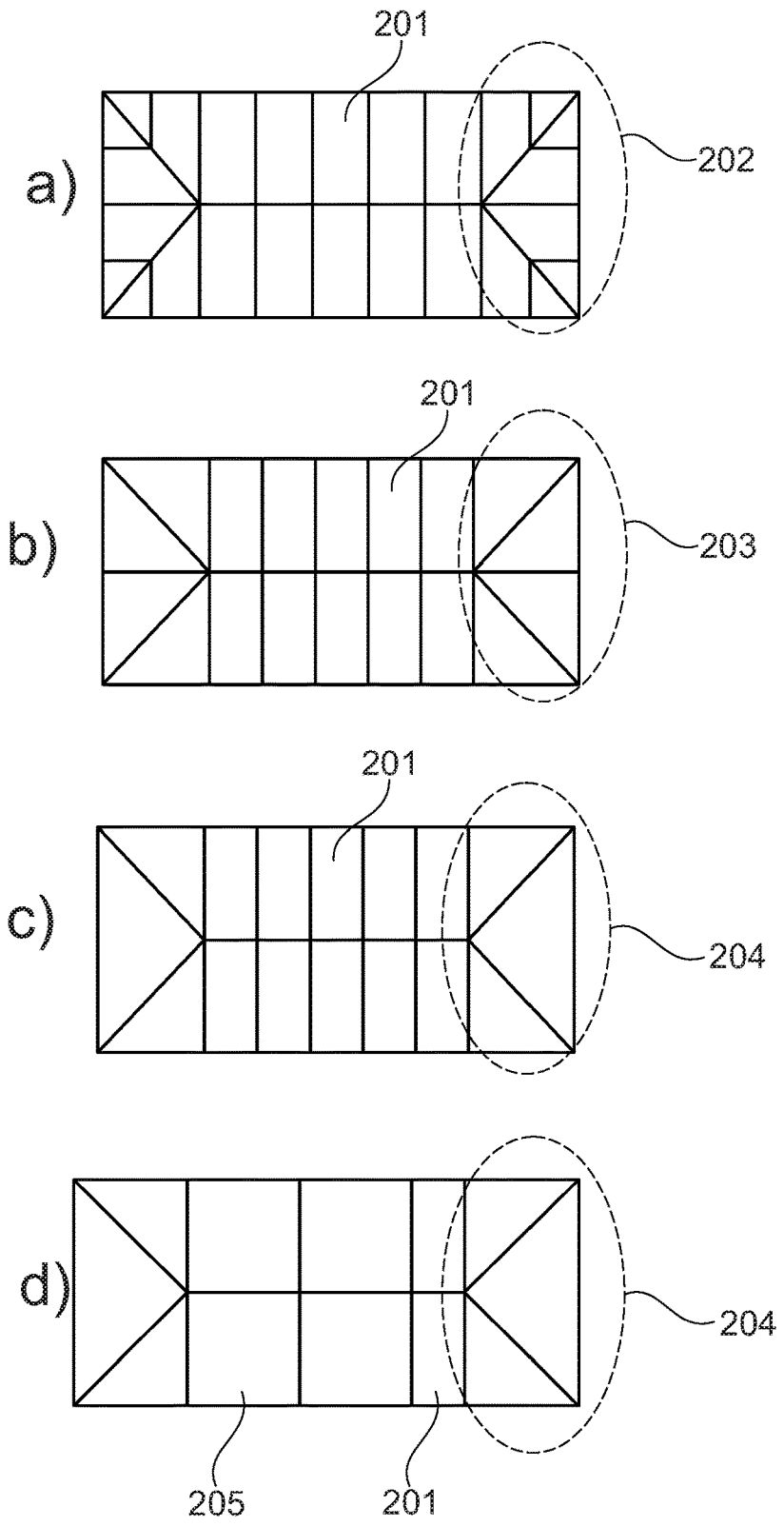
FIG. 2 shows various arrangements of arrays of cantilever beams with essentially no acoustical leakage.

As it will be demonstrated in connection with FIG. 2 arrays of cantilever beams may be implemented using various geometries. Starting with FIG. 2*a* two opposing rows of cantilever beams 201 is depicted. Each row comprises five cantilever beams 201 arranged next to each other. Each cantilever beam 201 comprises a fixed end and an oppositely arranged moveable end. The moveable end of each cantilever beam 201 is the end in the middle portion of the array, whereas the fixed cantilever end is at the edge of the array. In order to prevent, or at least reduce, acoustical leakage through the array a total of eight moveable elements are arranged on both sides of the ten cantilever beams 201. The eight moveable elements to the right of the ten cantilever beams 201 are encircled and denoted 202 in FIG. 2*a*. The corresponding eight moveable elements to the left of the ten cantilever beams 201 are identical. The 16 moveable elements in FIG. 2*a* are adapted to follow the deflections of the cantilever beams 201 in order to form a moveable diaphragm and to prevent that uncontrolled amounts of air escape through the two regions each containing eight moveable elements. FIG. 2*b* shows a similar arrangement of cantilever beams 201, i.e. ten cantilever beams arranged in two rows with the moveable ends of the cantilever beams facing each other in the middle portion of the array. Compared to FIG. 2*a* the number of moveable elements in the region 203 has been reduced to four. Again, the ten cantilever beams 201 and the eight moveable elements form, in combination, a moveable diaphragm. In FIGS. 2*c* and 2*d* the number of moveable elements in the region 204 has been further reduced to three. Moreover, in FIG. 2*d* the number of cantilever beams 201, 205 has been reduced to six including four wide cantilever beams 205 and two narrow cantilever beams 201.

Figure 3:
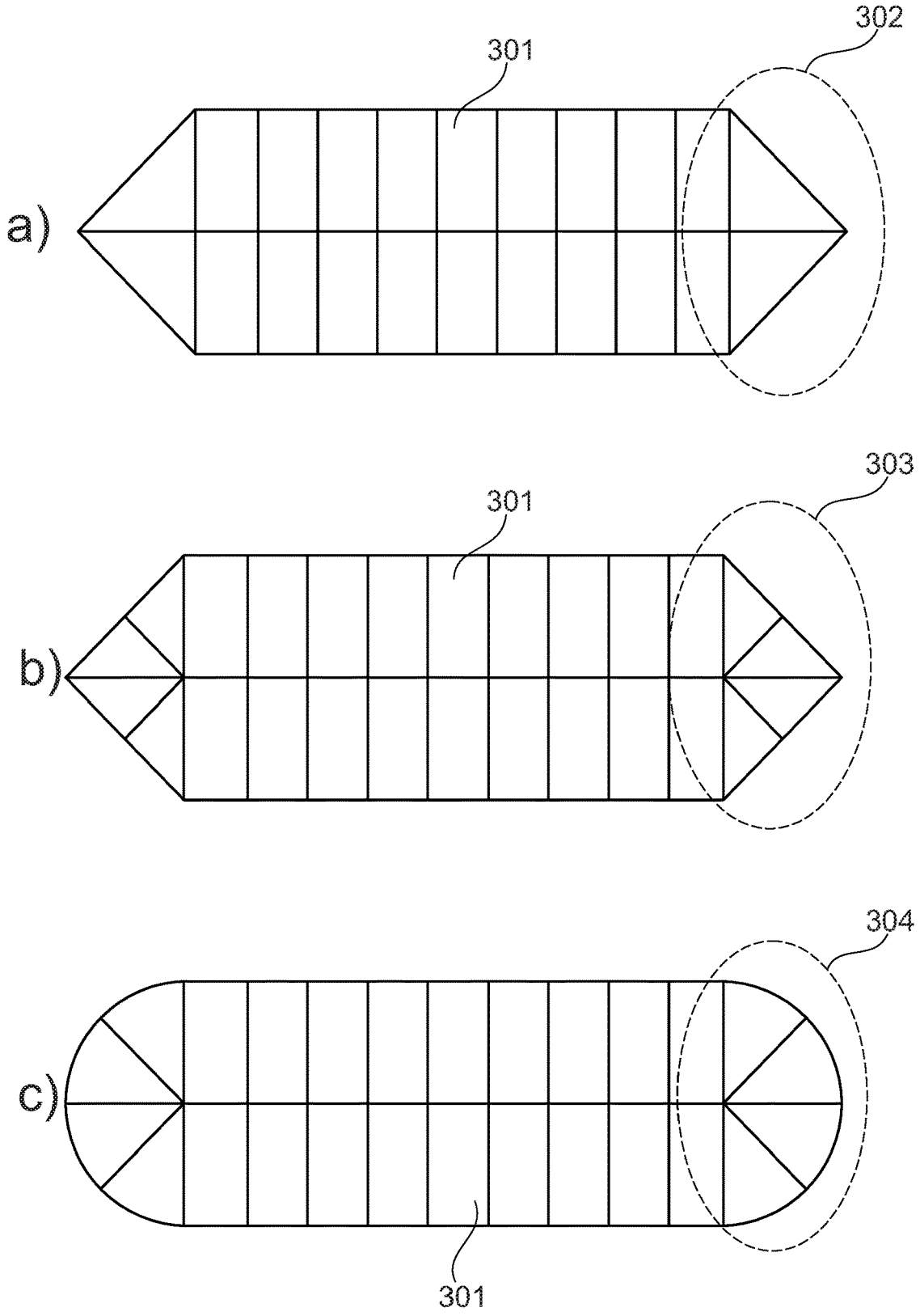
FIG. 3 shows further arrangements of arrays of cantilever beams with essentially no acoustical leakage.

Referring now to FIGS. 3*a*-3*c* arrays of cantilever beams each comprising 18 cantilever beams 301 arranged in two rows are depicted. The moveable end of each cantilever beam 301 is the end in the middle portion of the array. In FIG. 3*a* triangular regions of moveable elements are provided to both the left and right of the 18 cantilever beams. The triangular region 302 to the right comprises two moveable elements which are adapted to follow the deflections of the cantilever beams 301 in order to form an air tight seal and thus prevent an acoustical leakage through this region 302. This also applies to the region to the left of the 18 cantilever beams. In FIG. 3*b* the triangular region 303 comprises four moveable elements which are also adapted to follow the deflections of the cantilever beams 301 in order to form an air tight seal and thus prevent an acoustical leakage through this region 303. This also applies to the region to the left of the 18 cantilever beams in FIG. 3*b*. In FIG. 3*c* the semi-circular region 304 also comprises four moveable elements which are adapted to follow the deflections of the cantilever beams 301 in order to prevent an acoustical leakage. In FIGS. 3*a*-3*c* the cantilever beams 301 and the moveable elements form, in combination, a moveable diaphragm.

Figure 4:
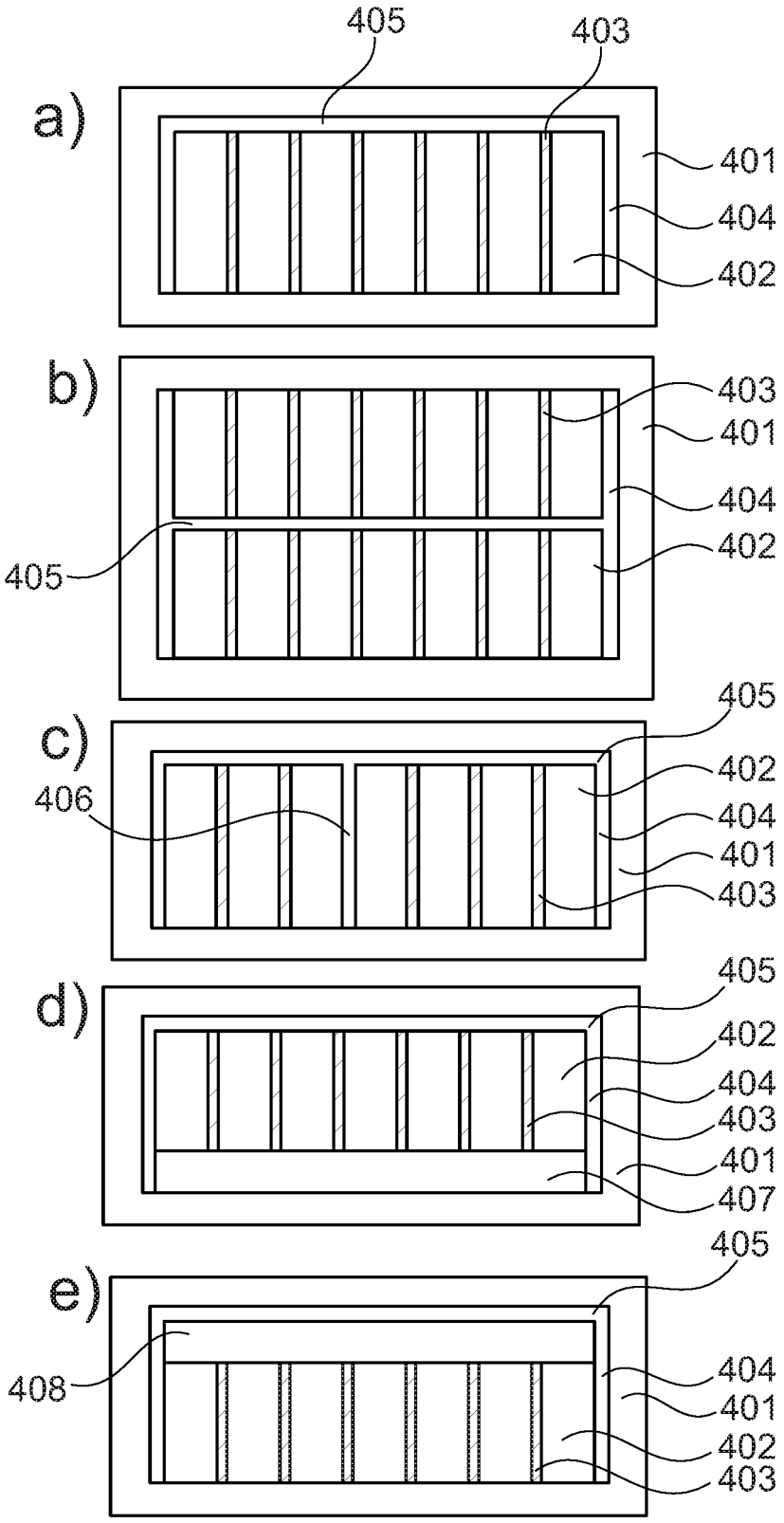
FIG. 4 shows various top views of connected cantilever beams.

Turning now to FIG. 4 various arrangements for connecting a plurality of cantilever beams are depicted via top views. Cantilever beams may be mutually connection in order to form an air tight seal and thus prevent acoustical leakages and/or they may be mutually connected in order to synchronise movements of a plurality of cantilever beams.

Referring now to FIG. 4*a* a single row of seven cantilever beams 402 is depicted. These cantilever beams are either secured to or integrated with a MEMS die 401 which thus forms a frame structure. As depicted in FIG. 4*a* air gaps 404, 405 exist between the cantilever beams 402 and the MEMS die 401, i.e. next to the cantilever beams 402 (air gap 404) as well as at the ends of the cantilever beams 402 (air gap 405). As previously mentioned openings or gaps exist between the cantilever beams 402. As depicted in FIG. 4*a* a filling material in the form of one or more material layers 403 fill out the openings or gaps between the cantilever beams 402 and thus connect the cantilever beams 402. The seven cantilever beams 402 thus form an integrated and moveable element. In FIG. 4*b* two opposing rows of seven cantilever beams 402 are depicted. Again, the cantilever beams are either secured to or integrated with a MEMS die 401 which thus forms a frame structure. As depicted in FIG. 4*b* air gaps 404, 405 exist between the cantilever beams 402 and the MEMS die 401, i.e. next to the cantilever beams 402 (air gap 404), as well as between opposing ends of the cantilever beams 402 (air gap 405). A filling material in the form of one or more material layers 403 fill out the openings or gaps between the cantilever beams 402 and thus connect the cantilever beams 402. The upper and lower rows of cantilever beams thus each form an integrated and moveable element. In FIG. 4*c* a single row of seven cantilever beams 402 is depicted. Again, these cantilever beams are either secured to or integrated with a MEMS die 401 which thus forms a frame structure. As depicted in FIG. 4*a* air gaps 404, 405, 406 exist between the cantilever beams 402 and the MEMS die 401, i.e. next to the cantilever beams 402 (air gap 404), at the ends of the cantilever beams 402 (air gap 405) as well as between the third and fourth cantilever beams (air gap 406). As depicted in FIG. 4*c* a filling material in the form of one or more material layers 403 fill out the openings or gaps between the first, second and third cantilever beams 402 (counted from the left) and between the fourth, fifth, sixth and seventh cantilever beams 403. The seven cantilever beams 402 are thus grouped into two groups of cantilever beams. Referring now to FIG. 4*d* a single row of seven cantilever beams 402 is depicted again. These cantilever beams are either secured to or integrated with a MEMS die 401 via a bridging element 407. The MEMS die 401 forms a frame structure relative to the cantilever beams 402 which may be shorter compared to the implementations discussed previously. As depicted in FIG. 4*d* air gaps 404, 405 exist between the cantilever beams 402 and the MEMS die 401, i.e. next to the cantilever beams 402 (air gap 404) as well as at the ends of the cantilever beams 402 (air gap 405). Again, a filling material in the form of one or more material layers 403 fill out the openings or gaps between the cantilever beams 402 and thus connect the cantilever beams 402 so that they form an integrated and moveable element. Referring now to FIG. 4*e* a single row of seven cantilever beams 402 is depicted. The cantilever beams are either secured to or integrated with a MEMS die 401 which thus forms a frame structure. A bridging element 408 connects the moveable ends of the cantilever beams. As depicted in FIG. 4*e* air gaps 404 exist between the cantilever beams 402 and the MEMS die 401, i.e. next to the cantilever beams 402 (air gap 404). Air gaps 405 also exist between the bridging element 408 and the MEMS die 401. As previously mentioned openings or gaps exist between the individual cantilever beams 402. A filling material in the form of one or more material layers 403 fill out these openings or gaps and thus connect the cantilever beams 402. The seven cantilever beams 402 thus form an integrated and moveable element.

It should be noted that the dimensions of the air gaps 404, 405, 406 remain essentially unaffected during bending or deflection of the cantilever beams 402 thus maintaining the acoustical leakage through the air gaps 404, 405, 406 at a minimum. The widths of the air gaps 404, 405, 406 are, as previously addressed, typically in the range between 0.5 μm and 5 μm.

Figure 5:
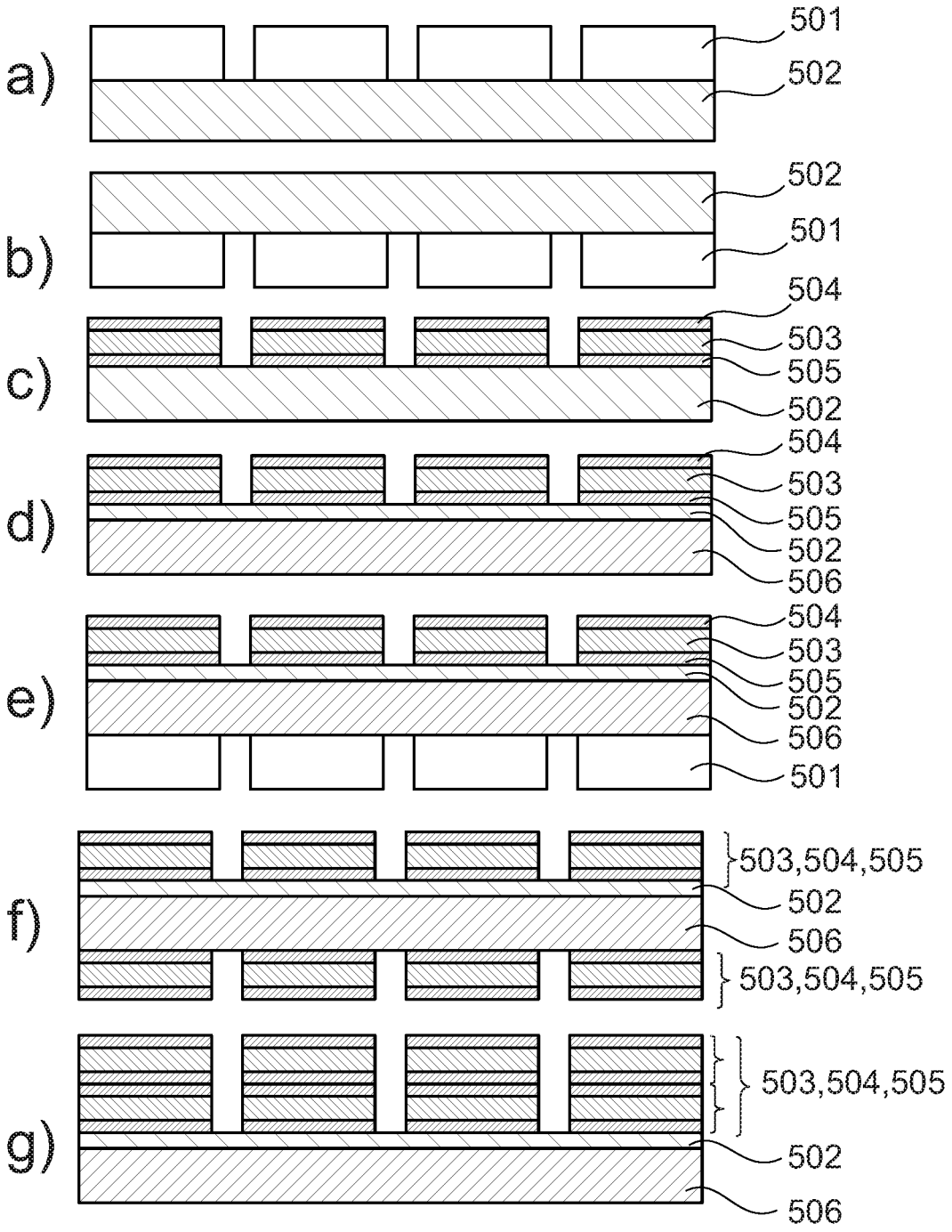
FIG. 5 shows various cross-sectional views of connected cantilever beams.

Referring now to FIG. 5 various arrangements for connecting a plurality of cantilever beams are depicted via cross-sectional views. In FIG. 5*a* four cantilever beams 501 are connected via one or more material layers 502 provided below the cantilever beams 501. In FIG. 5*b* four cantilever beams 501 are connected via one or more material layers 502 provided above the cantilever beams 501. In FIG. 5*c* four cantilever beams each comprising a piezoelectric material 503 sandwiched between two electrodes 504, 505 are connected via one or more material layers 502 provided below the cantilever beams. In FIG. 5*d* four cantilever beams each comprising a piezoelectric material 503 sandwiched between two electrodes 504, 505 are connected via one or more material layers 502 provided below the cantilever beams. A carrier substrate 506 is provided below the one or more material layers 502. In FIG. 5*e* four cantilever beams each comprising a piezoelectric material 503 sandwiched between two electrodes 504, 505 are connected via one or more material layers 502 and a carrier substrate 506 provided below the cantilever beams. Four additional cantilever beams 501 are provided below the carrier substrate 506. In FIG. 5*f* four cantilever beams each comprising a piezoelectric material 503 sandwiched between two electrodes 504, 505 are connected via one or more material layers 502 and a carrier substrate 506 provided below the cantilever beams. Four additional cantilever beams each comprising a piezoelectric material 503 sandwiched between two electrodes 504, 505 are provided below the carrier substrate 506. In FIG. 5*g* four pairs of stacked cantilever beams, i.e. eight cantilever beams in total, where each cantilever beam comprises a piezoelectric material 503 sandwiched between two electrodes 504, 505. The four pairs of cantilever beams are mutually connected via one or more material layers 502 and a carrier substrate 506 provided below the four pairs of cantilever beams.

Figure 6:
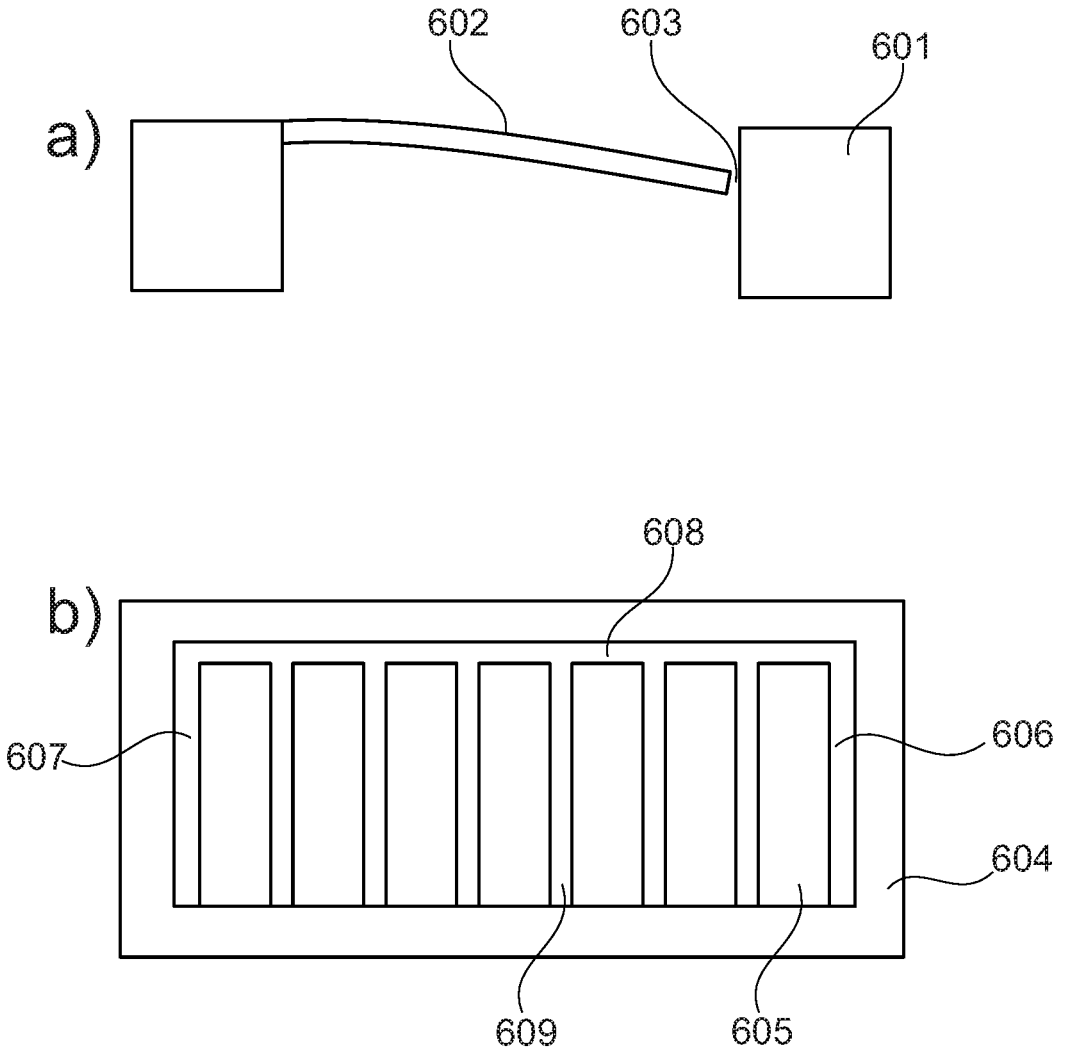
FIG. 6 shows a cross-sectional view of a pre-bended cantilever beam, and a top view of a row of pre-bended cantilever beams.

Referring now to FIG. 6 an implementation relying on a pre-bended cantilever beam 602 is depicted. With reference to the cross-sectional view in FIG. 6*a* the pre-bended cantilever beam 602 is either secured to or integrated with the MEMS die 601 which thus forms a frame structure relative to the pre-bended cantilever beam 602. As depicted in FIG. 6*a* and as previously discussed a small air gap 603 exists between the cantilever beam 602 and the MEMS die 601. In order to prevent, or at least reduce, acoustical leakage through the air gap 603, it is dimensioned so that essentially no sound pressure waves above 2 kHz are capable of passing through the air gap 603 which thus functions as an acoustical low-pass filter. Referring now to FIG. 6*b* a top view of a row of seven pre-bended cantilever beams 605 is depicted. Again, a MEMS die 604 to which the cantilever beams 605 are either secured or integrated with forms a frame structure. Various air gaps 606, 607, 608 exist between the cantilever beams 605 and the MEMS die 604. Moreover, air gaps 609 exist between the individual cantilever beams. The widths of the air gaps 603, 606, 607, 608 are, as previously addressed, typically in the range between 0.5 μm and 5 μm.

As previously mentioned each of the cantilever beams 605 comprises an integrated drive mechanism in the form of a piezoelectric material sandwiched between two electrodes to which a drive signal may be applied in order to activate the cantilever beams. Moreover, one or more material layers may be provided to connect the seven cantilever beams in order to prevent, or at least reduce, acoustical leakage through the one-dimensional array of cantilever beams.

Figure 7:
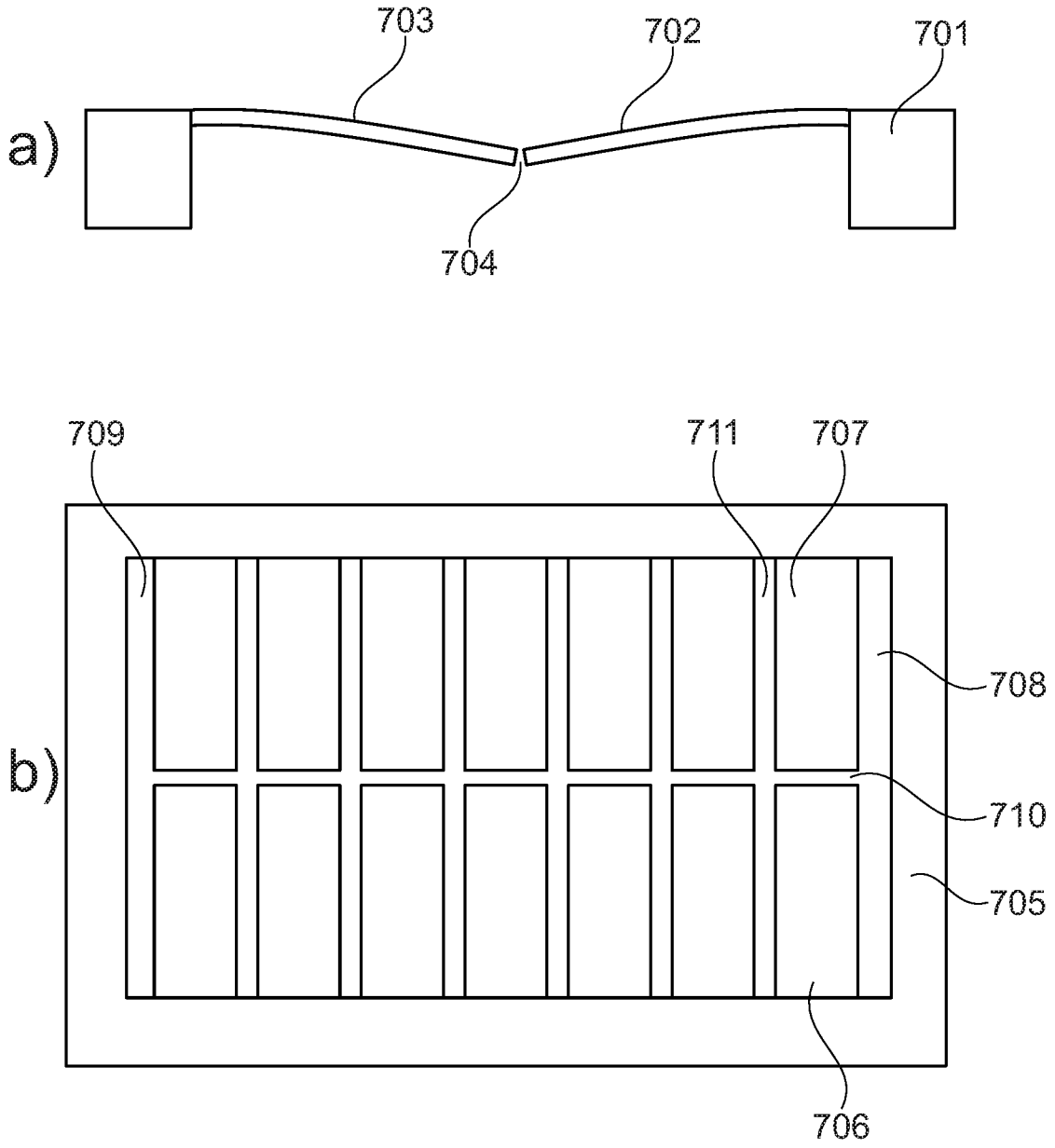
FIG. 7 shows a cross-sectional view of two opposing and pre-bended cantilever beams, and a top view of two rows of opposing and pre-bended cantilever beams.

FIG. 7 also shows an implementation relying on pre-bended cantilever beams 702, 703. With reference to the cross-sectional view in FIG. 7*a* pre-bended cantilever beams 702, 703 are either secured to or integrated with the MEMS die 701 which thus forms a frame structure relative to the pre-bended cantilever beams 702, 703. As depicted in FIG. 7*a* a small air gap 704 exists between the respective ends of the cantilever beams 702, 703. In order to prevent, or at least reduce, acoustical leakage through the air gap 704, the air gap is dimensioned so that essentially no sound pressure waves above 2 kHz are capable of passing through the air gap 704 which thus functions as an acoustical low-pass filter. In FIG. 7*b* a top view of two rows of seven pre-bended cantilever beams 706, 707 are depicted. Again, the MEMS die 705 to which the cantilever beams 706, 707 are either secured or integrated with forms a frame structure. Various air gaps 708, 709, 710 exist between the cantilever beams 706, 707 and the MEMS die 705. Moreover, air gaps 710 exist between the individual cantilever beams 706, 707. The widths of the air gaps 704, 708, 709, 711 are, as previously addressed, typically in the range between 0.5 μm and 5 μm. Each of the cantilever beams comprises an integrated drive mechanism in the form of a piezoelectric material sandwiched between two electrodes to which a drive signal may be applied in order to activate the cantilever beams. Moreover, one or more material layers may be provided to connect the seven cantilever beams of each row in order to prevent, or at least reduce, acoustical leakage through the two-dimensional array of cantilever beams.

In relation to FIGS. 6 and 7 it should again be noted that the dimensions of the various air gaps remain essentially unaffected during bending or deflection of the cantilever beams thus maintaining the acoustical leakage through the various air gaps at a minimum.

Figure 8:
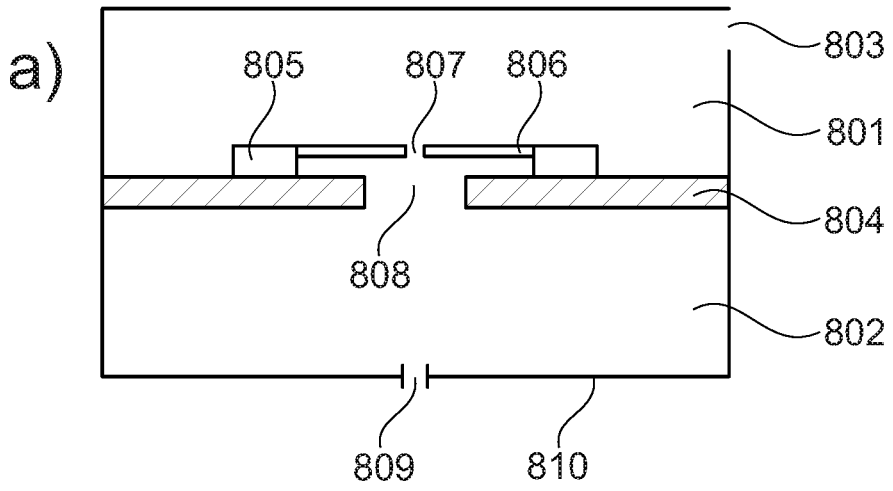
FIG. 8 shows two miniature speaker implementations.
Figure 8:
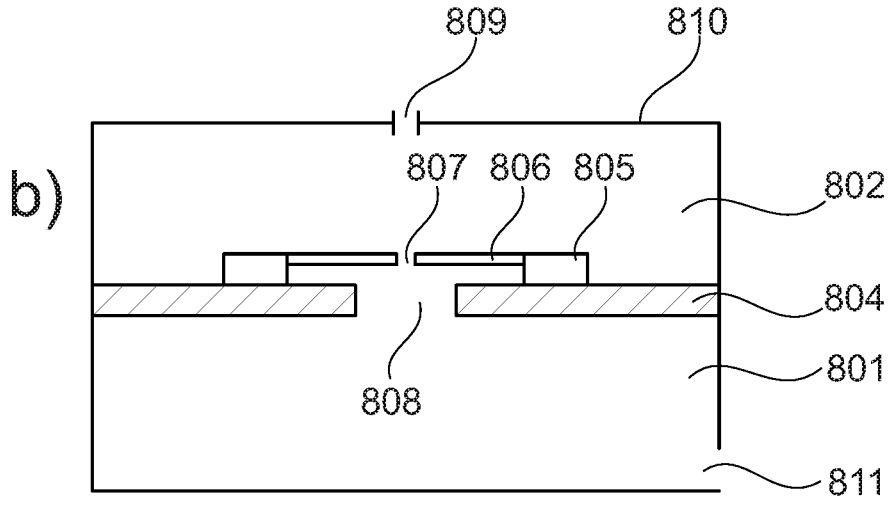

Turning now to FIG. 8 two implementations of miniature speakers are depicted. In FIG. 8*a* the miniature speaker comprises a front volume 801 and a rear volume 802 being separated by a substrate 804 to which a MEMS die 805 comprising opposing cantilever beams 806 is secured using appropriate means. As depicted in FIG. 8*a* a small air gap 807 (0.5-5 μm in width) exists between the respective ends of the opposing cantilever beams 806. The air gap 807 is dimensioned so that essentially no sound pressure waves above 2 kHz are capable of passing through the air gap 807 which thus functions as an acoustical low-pass filter. A through-going opening 808 is provided in the substrate 804 in a manner so that it is acoustically connected to the cantilever beams 806. Moreover, the front volume 801 is acoustically connected to a sound outlet 803, and a venting opening 809 is provided between the rear volume 802 and the exterior of the miniature speaker. In FIG. 8*b* the miniature speaker also comprises a front volume 801 and a rear volume 802 being separated by a substrate 804 to which a MEMS die 805 comprising opposing cantilever beams 806 is secured using appropriate means. Compared to FIG. 8*a* the front and rear volumes 801, 802 have been swapped with the sound outlet now being denoted 811. As the dimensions of the air gap 807 (0.5-5 μm in width) is essentially unaffected during bending or deflection of the cantilever beams the acoustical leakage between the front and rear volumes 801, 802 is maintained at a minimum level.

The invention claimed is:

1. A miniature speaker comprising a front and a rear volume, and one or more moveable diaphragms each comprising one or more cantilever beams and an associated acoustical low-pass filter having a predetermined acoustical cut-off frequency between 1 and 3 kHz, the filter having one or more air gaps arranged between the front and rear volumes, wherein each of the one or more cantilever beams is pre-bended along a longitudinal direction, and wherein the one or more cantilever beams are configured to bend or deflect away from the pre-bended shape in response to an applied drive signal, and wherein the one or more air gaps between the front and rear volumes remain essentially unaffected during bending or deflection of the one or more cantilever beams away from the pre-bended shape thus maintaining the acoustical leakage between the front and rear volumes at a minimum, wherein the one or more air gaps have a width between 0.5 μm and 5 μm.

2. A miniature speaker according to claim 1, wherein each of the one or more cantilever beams comprises a piezoelectric material sandwiched between two electrodes configured to receive the applied drive signal.

3. A miniature speaker according to claim 1, wherein the one or more cantilever beams are secured to or form part of a MEMS die.

4. A miniature speaker according to claim 3, wherein the MEMS die is arranged on a surface of a carrier substrate having a through-going opening arranged therein, and wherein the one or more cantilever beams of the MEMS die are acoustically connected to said through-going opening.

5. A miniature speaker according to claim 4, wherein the carrier substrate comprises a printed circuit board or a flex print, the printed circuit board or the flex print comprising electrically conducting paths configured to lead the drive signal to the one or more cantilever beams via the carrier substrate.

6. A miniature speaker according to claim 1, wherein pre-bending of each of the one or more cantilever beams is set individually.

7. A miniature speaker according to claim 1, wherein the one or more cantilever beams form an array of cantilever beams or a rectangular array of cantilever beams.

8. A miniature speaker according to claim 7, wherein the array of cantilever beams comprises a plurality of cantilever beams, and wherein a number of said cantilever beams are mutually connected via one or more material layers.

9. A miniature speaker according to claim 7, wherein the one or more air gaps exist between neighboring cantilever beams, or between one or more cantilever beams and a frame structure of the array of cantilever beams.

10. A miniature speaker according to claim 1, wherein the predetermined acoustical cut-off frequency is around 2 kHz.

11. A miniature speaker according to claim 1, wherein the front volume is acoustically connected to a sound outlet of the miniature speaker, wherein one or more venting openings are provided between the rear volume and an exterior volume of the miniature speaker.

12. A receiver assembly for a hearing device, the receiver assembly comprising a miniature speaker according to claim 1.

13. A hearing device, such as a receiver-in-canal hearing device, comprising a receiver assembly according to claim 12.

* * * * *